US006921296B2

(12) United States Patent
Lecinski et al.

(10) Patent No.: US 6,921,296 B2
(45) Date of Patent: Jul. 26, 2005

(54) CARD CAGE AND ELECTRONIC CARD APPARATUS AND SYSTEM

(75) Inventors: Daniel J. Lecinski, Arlington Heights, IL (US); Gerald Greco, Elk Grove, IL (US); Robert E. Sadler, Jr., Des Plaines, IL (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 10/369,905

(22) Filed: Feb. 20, 2003

(65) Prior Publication Data

US 2004/0166741 A1 Aug. 26, 2004

(51) Int. Cl.[7] ..... H01R 13/64
(52) U.S. Cl. ..... 439/680; 439/61
(58) Field of Search ..... 439/680, 681, 439/59, 61, 64, 65, 62, 633, 159, 160; 361/784, 786, 801, 789, 686, 796, 798, 753; 174/261

(56) References Cited

U.S. PATENT DOCUMENTS 3,614,714 A * 10/1971 Silverstein ..... 439/633
4,546,414 A * 10/1985 Donges ..... 361/786

* cited by examiner

*Primary Examiner*—Alexander Gilman
(74) *Attorney, Agent, or Firm*—Fitch, Even, Tabin & Flannery

(57) ABSTRACT

One or more keys (101, 102, 103) can be integrally formed of a card cage and positioned to extend into the card-receiving openings of the card slots that comprise the card cage. The cards can then have key-receiving openings (112, 114, 116) that accommodate such keys. By matching the keys to particular physical and electrical functionality and compatibility attributes of a given card slot, such key-receiving openings can be similarly shaped and sized to assure that such cards cannot be inadvertently (or purposely) placed in an inappropriate card slot. In varying embodiments, such keys can be formed of a cable trough, a front panel, and a card guide seating surface.

13 Claims, 4 Drawing Sheets

CARD CAGE AND ELECTRONIC CARD APPARATUS AND SYSTEM

TECHNICAL FIELD

This invention relates generally to card cages and electronic cards as used therewith.

BACKGROUND

Card cages are known in the art. In general, a card cage comprises a housing or frame adapted and configured to receive one or more cards (also known as boards or blades). Such cards usually include a main printed wiring board having various electronic components mounted thereon and further usually including a plurality of electrical connectors. These electrical connectors are often disposed proximal a rearward portion of the card and are positioned to mate with corresponding connectors that comprise a part of the card cage (for example, a given card cage will often include a backplane comprising a printed wiring board having circuit traces and connectors to provide for convenient coupling of the circuitry on the cards to other desired locations).

In general, such card cages are designed to comport with certain standard physical and/or electrical standards. For example, the height and depth of the card cage will typically be sized to accommodate a wide variety of cards. In similar fashion, many card cages have a backplane that will cooperate successfully with a variety of different cards as well. As a result, users of such products have a growing familiarity with and expectation that a given card cage will be able to accommodate a variety of different cards. This perception often further includes an expectation that each card slot as provided in a given card cage will be able to accommodate a wide variety (or all) cards regardless of card type or function.

Unfortunately, such is often not the case. In many cases, for good reason, a given card cage and/or a given card slot in a given card cage will not accommodate a given card. In some cases this mismatch comprises a physical mismatch, as where the electrical connectors on a given card do not all align properly with the corresponding connectors in the card cage. In other cases, the mismatch comprises an electrical mismatch, as where the electrical connectors match as between the card and the card cage but the signal-bearing and/or power-bearing paths so created are inappropriate and incorrect. In other cases, both kinds of mismatching can occur. In yet other instances, otherwise physically mismatched connectors are nevertheless still closely enough aligned that, with sufficient physical force being applied, at least some inappropriate connections can be forced.

When such mismatches occur, damage to the card, the card cage, and/or the system as a whole (including other cards in the card cage and/or other devices and components as are connected to or dependent upon the functionality of the card cage and its constituent cards) can result. Such damage may be temporary or permanent, and can include both electrical and physical damage to individual card components and/or the card as a whole.

Warnings and/or instructions regarding proper placement of a given card with respect to a given card cage or card slot can be provided to attempt to ameliorate such problems (for example, such warnings can be displayed on the card cage or on the card and/or can be provided on supplementary materials as are provided with the card or card cage). Unfortunately, such written information is often either ignored and/or unavailable at times of need. It is also difficult, when preparing such warnings and cautions, to anticipate future developments; for example, a given warning may suggest to a user that a particular kind of card should not be placed in a given card slot of a given card cage, when in fact a later-developed card of that particular kind may be properly designed and configured to function successfully in such a setting.

BRIEF DESCRIPTION OF THE DRAWINGS

The above needs are at least partially met through provision of card cage and electronic card apparatus and system described in the following detailed description, particularly when studied in conjunction with the drawings, wherein.

Figure 2:
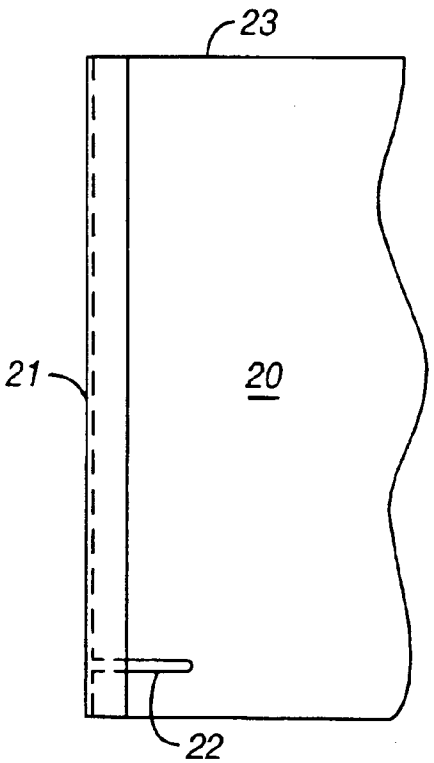
FIG. 2 (Prior Art)
FIG. 2 comprises a side elevational view of a portion of a prior art card.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION

Generally speaking, pursuant to these various embodiments, a card cage having at least one card slot that includes a corresponding card-receiving opening further includes at least one key formed integrally of the card cage, which key is disposed proximal to and extending into the card-receiving opening. In a preferred embodiment, the card cage includes a plurality of such card-receiving openings, wherein each of the openings has a corresponding key. In one embodiment, at least some of these keys differ from one another. In various embodiments, this difference can include variations with respect to horizontal dimensions, vertical dimensions, or both. In various embodiments, these keys can be integrally comprised of, for example, a cable trough, a card guide seating surface, and a front panel of the card cage.

In a preferred embodiment, an electronics card has a front panel and is at least partially disposable within a corresponding card slot of the card cage. In a preferred embodiment, the front panel includes at least one key-receiving opening that is sized and positioned such that a given predetermined key (or keys) will pass without obstruction through the key-receiving opening. Conversely, the front panel will serve to block the passage of other keys, such that the electronics card cannot be fully disposed and seated within the card cage. So configured, a given card slot of a card cage can be characterized, by the key associated therewith, as accepting only a given corresponding card (or family of cards). Similarly, a given card can be characterized, by the key-receiving opening provided therewith, such that the card can only be successfully fully installed within certain card slots.

These various embodiments then permit and facilitate a mechanism whereby cards and card cage slots can be readily and inexpensively characterized such that only specific cards, or cards of a specific family or other shared characteristic, are physically disposable within certain card slots. This, in turn, will aid in preventing an inappropriate card from being inserted into a given card cage card slot, thereby avoiding physical and/or electrical damage to the card, the card cage, other components of the card cage, and/or other system elements as may be coupled to or are otherwise dependent upon the operations and functionality of the card cage. These embodiments will readily accommodate both present and future-developed cards and card cages. Furthermore, these benefits accrue with virtually no cost in materials and, to a large extent, without significant cost during processing and manufacture.

Figure 1:
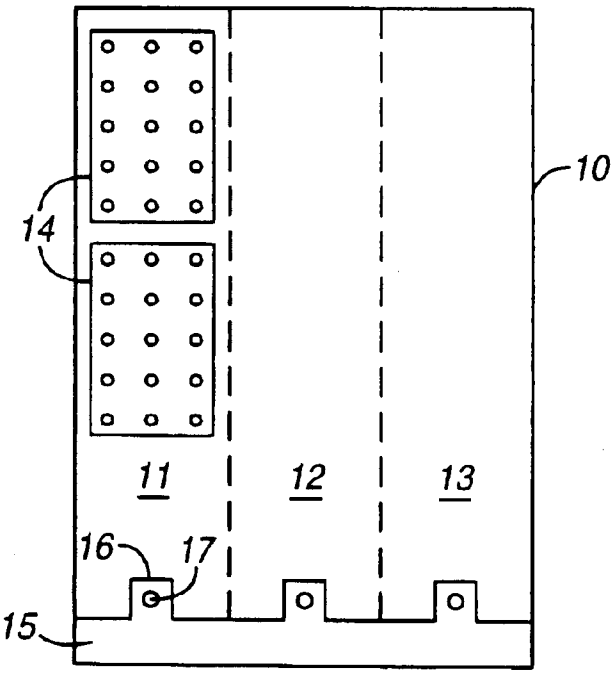
FIG. 1 (Prior Art)
FIG. 1 comprises a front elevational view of a portion of a prior art card cage.

Referring now to FIG. 1, a card cage 10 as typically found in the prior art includes a plurality of card slots 11, 12, and 13 (three such slots are depicted here to illustrate the concept, with it being understood that many or most such card cages more typically comprise a great many additional card slots in addition to these three). A backwall of the card cage 10 typically comprises a backplane or other mechanism having a plurality of connectors 14 disposed thereon, such that a properly inserted card will couple and interact with the connectors 14. In addition, the card cage 10 includes a front panel 15 disposed along the bottom leading edge of the front of the card cage 10, which front panel 15 often includes a tab 17 having an alignment hole 17 disposed therethrough. The above elements are well understood in the art and hence additional description will not be set forth here for the sake of brevity and the preservation of focus. In addition, it will be understood that a typical card cage also includes other aspects and components that are neither mentioned nor illustrated as they are not especially relevant to the embodiments described herein.

Referring now to FIG. 2, a typical card 20 for use with such a card cage 10 usually includes a components-bearing member 23 and a front panel 21. The front panel 21 often includes an alignment pin 22 that is sized and positioned to mate appropriately with the alignment hole 17 provided on the front panel 15 of the card cage 10. So configured, such a card 20 can be disposed within any of the card slots 11, 12, or 13 of the card cage 10 and the alignment pin 22 will align appropriately with the alignment hole 17 of the front panel 15. Such alignment, of course, does not mean that a given card 20 will seat appropriately in a given card slot. There may exist, for example, a physical and/or electrical mismatch as between the card cage connectors 14 and the corresponding connectors (not shown) on the card 20 itself as noted earlier.

Figure 3:
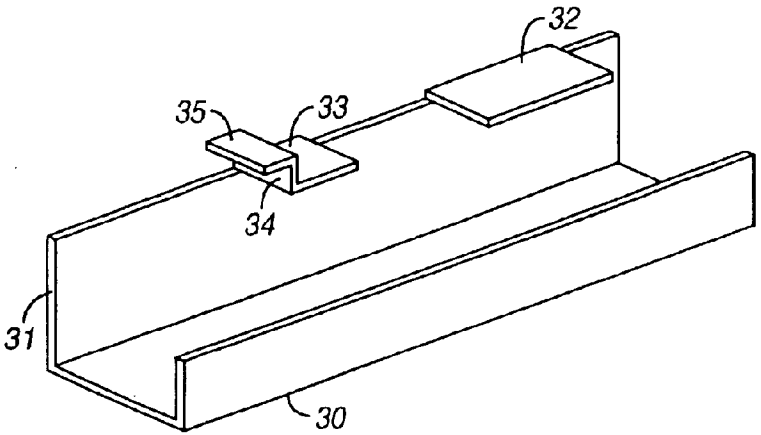
FIG. 3 comprises a perspective view of a cable trough as configured in accordance with an embodiment of the invention.
Figure 5:
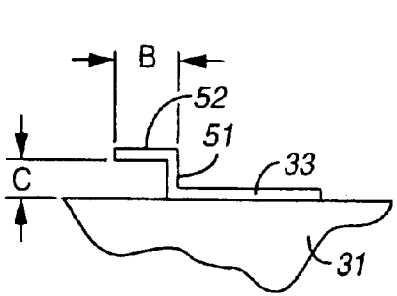
FIG. 5 comprises a front elevational detail view of a key as configured in accordance with an embodiment of the invention.
Figure 6:
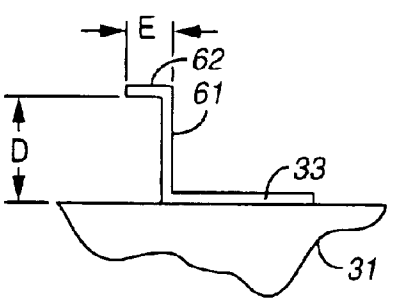
FIG. 6 comprises a front elevational detail view of a key as configured in accordance with an embodiment of the invention.
Figure 4:
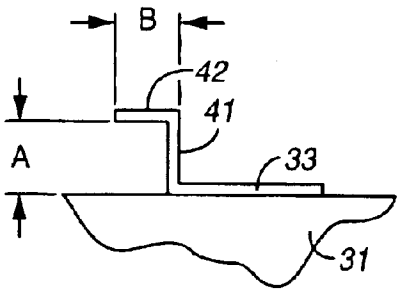
FIG. 4 comprises a front elevational detail view of a key as configured in accordance with an embodiment of the invention.

Many such card cages 10 have a cable trough disposed in front of the card cage 10 on a lower portion thereof. Pursuant to one embodiment, such a cable trough can have one or more keys formed thereof. For example, with reference to FIG. 3, a typical cable trough 30 comprised of an appropriate metal and having a back wall 31 will usually have a plurality of fingers 32 disposed at least partially over the top of the trough 30 to aid in retaining cables within the trough 30. Pursuant to one embodiment, at least one of these fingers 33 can have a first portion 34 thereof bent vertically and a second portion 35 thereof bent horizontally to form a key. Such a key can be configured in a variety of ways. For example, with reference to FIG. 4, the vertical portion 41 can have a first length "A" and the horizontal portion 41 can have a second length "B". In a different embodiment, and referring now to FIG. 5, the vertical portion 51 can have a smaller length "C" while the horizontal portion 52 can have the same length "B" as with the previous embodiment. Or, as yet another example, and referring now to FIG. 6, the vertical portion 61 can have a longer length "D" than before while the horizontal portion 62 can have a shorter length "E" than before. Of course, many other permutations and combinations are possible as well. In general, the key can be sized and shaped in a variety of ways to thereby provide a variety of differing keys. Differences can be facilitated through varying horizontal dimensions, vertical dimensions, or both, and/or by altering the shape of the key (for example, through use of a variety of straight and curved surfaces).

Figure 8:
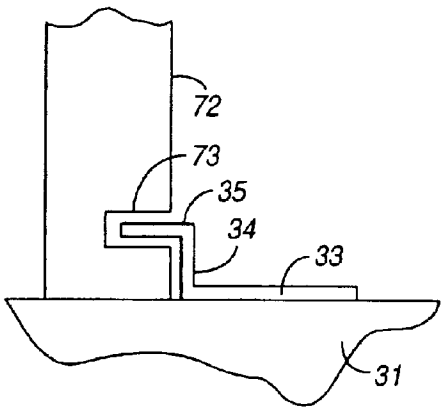
FIG. 8 comprises a front elevational detail view of a card and a key as configured in accordance with an embodiment of the invention.
Figure 7:
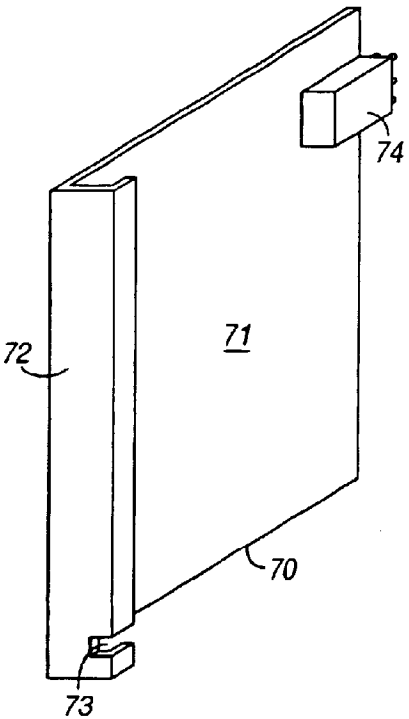
FIG. 7 comprises a perspective view of a card as configured in accordance with an embodiment of the invention.

Referring now to FIG. 7, an electronic component-bearing card 70 having a card member 71 that is adapted and configured to be disposed within a card slot of a card cage can be provided with a front panel 72 having a key-receiving opening 73, such as an appropriately sized and positioned notch, formed therein. With reference to FIG. 8, when the key-receiving opening 73 matches and otherwise corresponds to the key (and in this embodiment, particularly to the horizontal portion 34 of the key), the card 70 can be full disposed and seated within the card slot of the card cage 10 sufficient to permit the connectors 74 (FIG. 7) on the card 70 to mate with the card cage connectors 14 (FIG. 1). So configured, when one attempts to dispose such a card within a card slot having a key comprising a horizontal portion 35 that is disposed higher or lower than as depicted in FIG. 8, or that is considerably longer than as depicted in FIG. 8, the horizontal portion 35 will contact the front panel 72 of the card 70 and prevent the card 70 from being disposed any further in the card cage 10.

Figure 9:
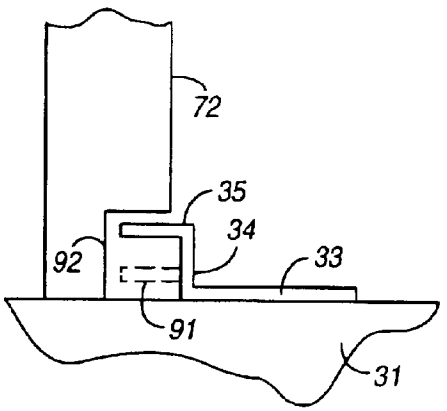
FIG. 9 comprises a front elevational detail view of a card and a key as configured in accordance with an embodiment of the invention.

It is possible that a particular card might be suitable for deployment in a variety of differing card slots. In this case, if desired, the key-receiving opening 73 can be configured to accommodate all of the keys that correspond to the card slots with which that particular card will function properly. For example, with reference to FIG. 9, the key-receiving opening 92 of a given card can be formed large enough to accommodate a horizontal portion 35 of a first key and a horizontal portion 91 of a second key. When the first key is used to characterize a first card slot and the second key is used to characterize a second card slot, the larger key-receiving opening 92 illustrated in this embodiment will permit the corresponding card to nevertheless be fully disposed within the card slot as the key-receiving opening 92 will pass and accommodate both keys.

Figure 11:
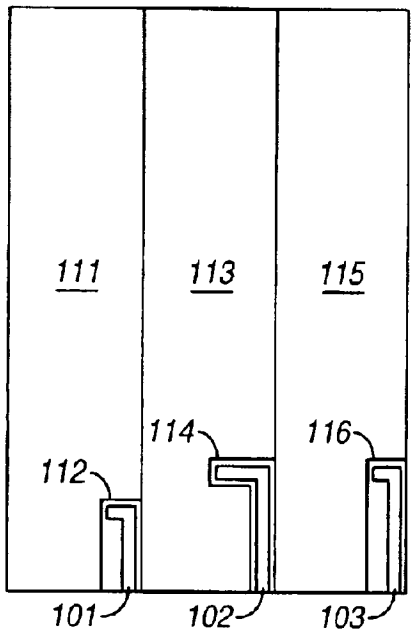
FIG. 11 comprises a front elevational view of a portion of a card cage with cards disposed therein as configured in accordance with an embodiment of the invention.
Figure 10:
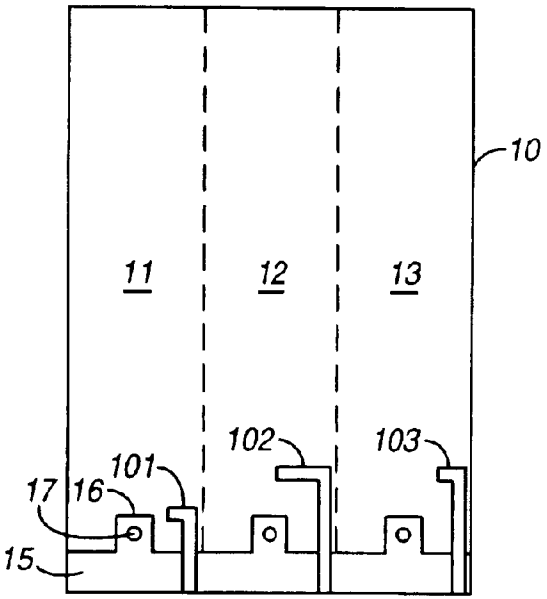
FIG. 10 comprises a front elevational view of a portion of a card cage as configured in accordance with an embodiment of the invention.

As already mentioned, such a cable trough comprises a part of many card cages. As a result, the keys as formed thereof further comprise keys that are also an integral part of the card cage itself For example, with reference to FIG. 10, various keys as formed of such a trough can be positioned to be both proximal to and to extend into the card-receiving opening of the corresponding card slots. As shown, a first key 101 extends into the card-receiving opening of a first card slot 11, a second key 102 extends into the card-receiving opening of a second card slot 12, and a third key 103 extends into the card-receiving opening of a third card slot 13. In this illustration, the three keys 101, 102, and 103 differ from one another (either with respect to horizontal and/or vertical dimensions) and hence can serve to uniquely differentiate each card slot from the other card slots. So configured, if desired, each such card slot can be dedicated to a particular function and/or form factor and a corresponding card as well. For example, and referring now to FIG. 11, a first card 111 having a first key-receiving opening 112 that will accommodate the first key 101 can be fully disposed within the corresponding card slot. A second card 113 having a key-receiving opening 114 that accommodates the second key 102 can be fully disposed within the second card slot, but would not be fully admitted into the first card slot, as the first key 101 would not pass through the key-receiving opening 114 of the second card 113. On the other hand, a third card 115 can have a key-receiving opening 116 that can accommodate a family of keys, including, in this illustration, both the key 103 provided for the third card slot and the key 101 provided for the first card slot. As already suggested above, such a multi-key compatibility mechanism could be used for a later-developed card that is compatible with a plurality of different kinds of card slots.

Figure 12:
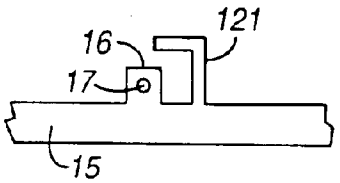
FIG. 12 comprises a front elevational detail view of a key as configured in accordance with yet another embodiment of the invention.
Figure 13:
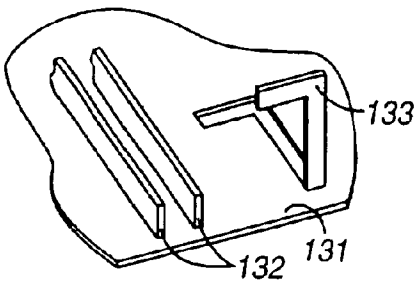
FIG. 13 comprises a perspective detail view of a key as configured in accordance with yet another embodiment of the invention.

In the examples provided above, the key comprises an integral part of the card cage assembly. In the particular examples provided, the key is formed from a cable trough. There are other ways, of course, in which the key can be integrally provided as a part of the card cage. For example, with reference to FIG. 12, a given key 121 can be formed of the front plate 15 as otherwise described above. As another example, and with reference to FIG. 13, a given key 133 can be formed of the card guide seating surface 131 (which surface 131 typically supports a track 132 for receiving an edge of the card when disposed within the card slot of the card cage as well understood in the art).

So configured, one or more keys formed integral of a card cage can be used to characterize a given corresponding card slot (or card slots, as desired and appropriate to a given application) with respect to physical and electrical functionality and compatibility. Corresponding key-receiving openings in cards can then be used to permit, or prohibit, the placement of such cards within such card slots. In this way the actions of a given operator can be better protected from inadvertently placing, or attempting to seat, an inappropriate card into a wrong card slot in a card cage. In addition to providing a simple and effective solution, this approach also comprises a relatively inexpensive option as well.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. For example, in the illustrations above, the keys are shown as used in conjunction with alignment holes as are otherwise understood in the art. If desired, the keys could be used alone and without such alignment holes. As another example, more than one key could be used in conjunction with a single given card slot if so desired.

We claim:

1. A card cage comprising:

at least one card slot having a corresponding card-receiving opening;

at least one key formed integrally of the card cage and being disposed proximal to and extending into the card-receiving opening, such that an electronics card having a key-receiving opening formed in a front panel thereof of appropriate size and position can be fully disposed within the at least one card slot while an electronics card not having such a key-receiving opening will be at least partially blocked from being fully disposed within the at least one card slot;

a cable trough having horizontal fingers disposed proximal an upper portion thereof, wherein the at least one key is integrally formed of the cable trough and, at least in part, of at least one of the horizontal fingers.

2. The card cage of claim 1 and further comprising an alignment opening formed therein, such that a corresponding alignment member as disposed on an electronics card can be disposed therein to aid in properly aligning a position of the electronics card within the card slot.

3. The card cage of claim 1 and further comprising a card guide seating surface, and wherein the at least one key is integrally formed of the card guide seating surface.

4. The card cage of claim 3 wherein the card guide seating surface includes a front face, and where the at least one key is integrally formed, at least in part, of the front face.

5. The card cage of claim 1 and further comprising a plurality of the card slots.

6. The card cage of claim 5 wherein a plurality of the card slots each includes at least one of the at least one key.

7. The card cage of claim 6 wherein each of the plurality of card slots includes at least one of the keys.

8. An apparatus comprising:

a card cage comprising:

at least one card slot having a corresponding card-receiving opening;

at least one key formed integrally of the card cage and being disposed proximal to and extending into the card-receiving opening;

at least one electronics card having a first edge with a plurality of electrical connectors and a second edge having a front panel, the at least one electronics card being at least partially disposed within the card slot and having at least one key-receiving opening formed in the front panel and being sized and positioned such that the key passes without obstruction through the key-receiving opening when the electronics card is moved into the card slot.

9. The apparatus of claim 8 wherein the card cage further includes a backplane having a plurality of electrical connectors.

10. The apparatus of claim 9 wherein the plurality of electrical connectors of the at least one electronics card physically and electrically mate with at least some of the electrical connectors of the backplane.

11. The apparatus of claim 8 wherein the card cage includes a plurality of card slots.

12. The apparatus of claim 11 wherein a plurality of the card slots each has at least one key formed integrally of the card cage and being disposed proximal to and extending into the card-receiving opening that corresponds to each of the card slots.

13. The apparatus of claim 12 and further comprising a plurality of the electronics cards, wherein each of the plurality of electronics cards is at least partially disposed within a corresponding one of the card slots.

* * * * *